US006193574B1

(12) United States Patent
Pollack

(10) Patent No.: US 6,193,574 B1
(45) Date of Patent: Feb. 27, 2001

(54) VESSEL COMPRISING A SWIVEL ASSEMBLY

(75) Inventor: Jack Pollack, Monaco (MC)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 09/331,842

(22) PCT Filed: Oct. 28, 1998

(86) PCT No.: PCT/EP98/06999

§ 371 Date: Jun. 28, 1999

§ 102(e) Date: Jun. 28, 1999

(87) PCT Pub. No.: WO99/21754

PCT Pub. Date: May 6, 1999

(30) Foreign Application Priority Data

Oct. 28, 1997 (EP) ..... 97203338

(51) Int. Cl.[7] ..... B63B 22/02

(52) U.S. Cl. ..... 441/4; 405/224.2

(58) Field of Search ..... 441/3, 4, 5; 285/272, 285/273, 274; 405/224.2; 166/335, 346

(56) References Cited

U.S. PATENT DOCUMENTS

| | | | | |
|---|---|---|---|---|
| 2,781,134 | * | 11/1957 | Weir et al. | 212/285 |
| 3,082,440 | * | 3/1963 | Rhedin | 441/5 |
| 3,120,106 | | 2/1964 | Foster . | |
| 3,237,220 | * | 3/1966 | Brandt | 441/5 |
| 3,957,291 | * | 5/1976 | Edling et al. | 285/136 |
| 3,969,781 | * | 7/1976 | Reid, Jr. | 9/8 P |
| 4,126,336 | * | 11/1978 | Ortloff et al. | 285/136 |
| 4,138,751 | * | 2/1979 | Kentosh | 9/8 P |
| 4,174,127 | * | 11/1979 | Carn et al. | 285/190 |
| 4,270,611 | * | 6/1981 | Arnaudeau et al. | 166/344 |
| 4,320,545 | | 3/1982 | Pomonik . | |
| 4,602,586 | * | 7/1986 | Ortloff | 114/230 |
| 4,647,077 | * | 3/1987 | Ethridge et al. | 285/98 |
| 5,052,322 | * | 10/1991 | Poldervaart et al. | 114/230 |
| 5,071,171 | * | 12/1991 | Perratone | 285/136 |
| 5,823,837 | * | 10/1998 | Boatman et al. | 441/5 |
| 5,983,931 | * | 11/1999 | Ingebrigtsen et al. | 137/580 |

FOREIGN PATENT DOCUMENTS

| | | | | |
|---|---|---|---|---|
| 1444345 | * | 7/1976 | (GB) | 441/5 |
| 1447413 | | 8/1976 | (GB) . | |
| 1549766 | | 8/1979 | (GB) . | |
| WO 93/24733 | | 12/1993 | (WO) . | |

* cited by examiner

*Primary Examiner*—S. Joseph Morano
*Assistant Examiner*—Ajay Vasudeva
(74) *Attorney, Agent, or Firm*—Young & Thompson

(57) ABSTRACT

A vessel includes a swivel assembly wherein each swivel is individually connected to a support structure with the swivels not being interconnected in a weight-bearing manner, and piping extending within a central space of the swivel assembly having individual pipe segments which can be disconnected for removal of one swivel in the radial direction.

7 Claims, 5 Drawing Sheets

VESSEL COMPRISING A SWIVEL ASSEMBLY

The invention relates to a vessel comprising a swivel assembly with at least two swivels having a common central axis and a support structure carrying the swivel assembly, each swivel comprising an inner annular wall and concentric therewith an outer annular wall, the annular walls being connected via axial and radial bearings and defining a ring-shaped chamber therebetween.

DESCRIPTION OF THE RELATED ART

Such a swivel assembly is known from U.S. Pat. No. 4,111,467. In the swivel assembly according to this patent the core members of the different swivels are mutually interconnected by means of tension bolts. If one of the swivels from the assembly needs to be exchanged for maintenance or repair work, the core parts need to be disconnected and the upper swivels need to be lifted for one of the swivels to be removed from the assembly in a radial direction.

The outer piping that is connected to swivels that are located above the swivel which needs to be removed from the assembly, must also be disconnected. Hence the removal of a swivel from the known swivel assembly is a difficult and cumbersome operation. It is therefore an object of the present invention to provide a swivel assembly in which an individual swivel can be easily removed and/or exchanged without disturbing the other swivels, and without having to loosen the outer piping of adjacent swivels. It is a further object of the present invention to provide for a swivel assembly in which better access to the swivels is possible.

Hereto the vessel comprising a swivel assembly according to the present invention is characterised in that the support structure comprises at least two swivels connecting means which are connected to the respective outer or inner annular walls of the swivels and which at least substantially carry the weight of each swivel. In a preferred embodiment, no substantial weight-bearing constructions are present between the inner walls of the adjacent swivels and between the outer walls of the swivels.

Because each swivel is independently connected to the support structure, for instance via its outer annular wall, it is possible to exchange an individual swivel without removing the adjacent swivels and without disturbing the outer piping connected to adjacent swivels. By individually attaching the outer annular walls of each swivel to the support structure, the swivel spacing can be as large as needed and sufficient access space to the inner swivel piping can be achieved. As the piping can be closer to the swivel due to the easy accessibility of each swivel, the swivel size can be reduced. Because each outer annular wall is connected to the support structure, no individual drives for the rotation of the outer swivels are necessary.

The term "ring-shaped" chamber as used herein it is intended to comprise chambers with circular, square or other cross-section which have a generally toroidal shape.

SUMMARY OF THE INVENTION

According to one embodiment of a vessel according to the invention, the inner walls comprise an opening that is in fluid communication with the ring-shaped chamber and that is on one side in fluid communication with a duct connected to the inner annular wall. The ducts of the swivels extend in the axial direction within the central space bounded by the inner annular walls. The duct that is connected to the inner wall of a first swivel and which extends in the region of a second swivel located above or below the first swivel, is comprised of detachable pipe segments. Hereby the second swivel can be removed in the radial direction when the pipe segments of the first swivel are decoupled.

The supporting structure may comprise a frame which is mounted on the turret or on the hull, wherein the frame is placed in such a position with respect to the swivels that after disconnecting the swivels, they can be removed from the assembly in a radial direction. This means that the spacing between the support elements of the frame structure should be larger than the diameter of the outer annular walls.

When the frame is supported on the turret, the inner annular walls are mutually coupled by a rotation transfer member. At least one of the inner walls is connected to a rotation drive means that is connected to the hull. In this way the inner rings can be accurately rotated in conjunction with the hull of the vessel. The rotation transfer members may comprise for instance a bolt connection between each inner annular wall.

The vessel may comprise a gantry which extends above the turret, the rotation drive means being mounted on the gantry.

In an other embodiment, the frame of the swivel assembly is suspended from the gantry wherein the inner annular walls are mutually coupled by rotation transfer members and at least one of the inner walls is fixedly connected to the turret. In this way the outer rings will rotate with the vessel and no drive means are necessary as the weight of the outer rings is sufficiently low to be rotated by means of the gantry and the frame.

BRIEF DESCRIPTION OF THE DRAWINGS

Some embodiments of a vessel comprising a swivel assembly according to the present invention will be explained in detail with reference to the accompanying drawings. In the drawings.

DESCRIPTION OF THE PREFERRED EMBODIMENTS

Figure 1:
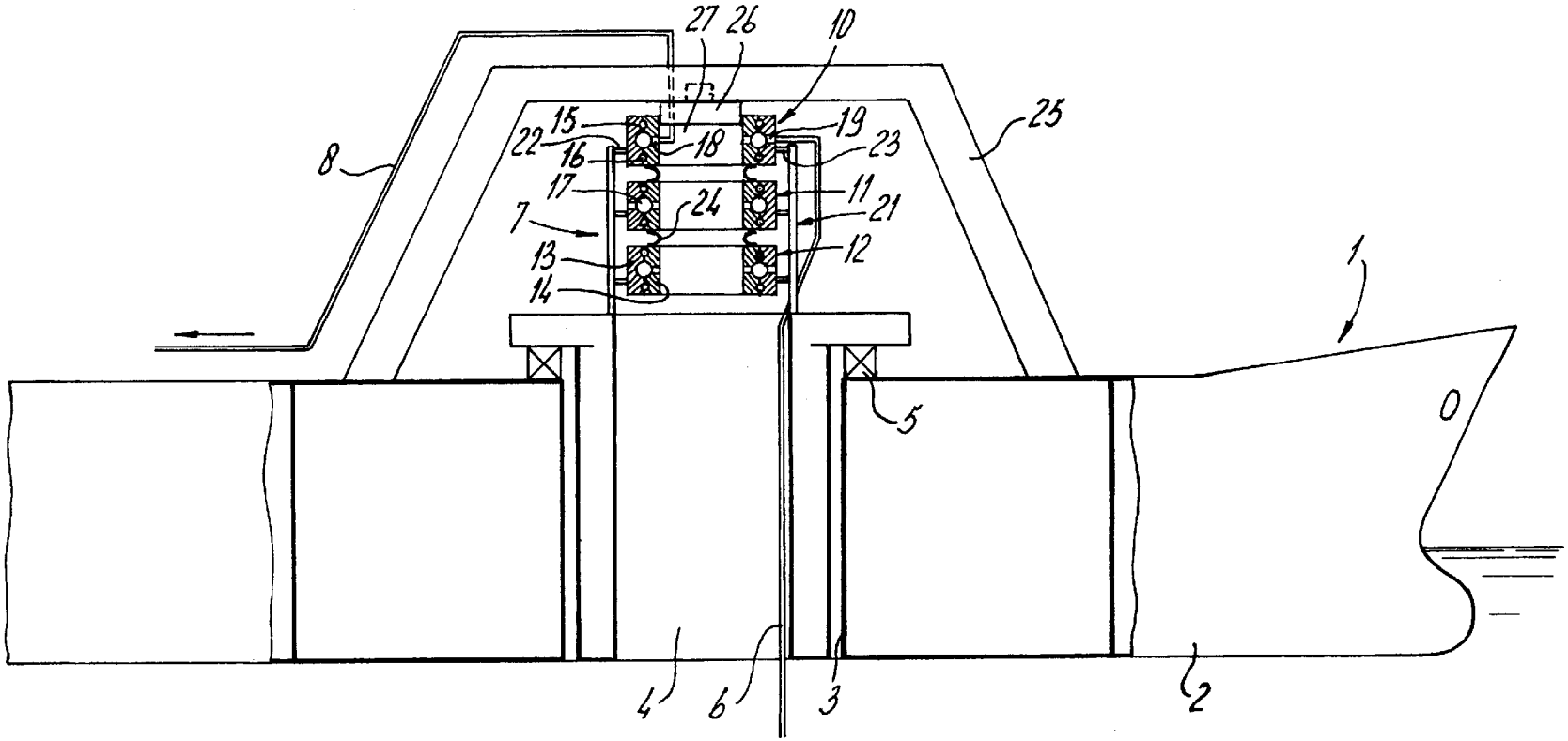
FIG. 1 is a schematic side view of a swivel according to the present invention wherein the frame is connected to the turret.

FIG. 1 shows a vessel 1, comprising a hull 2 in which a cylindrical opening or turret well 3 is provided. A turret 4 is located in the turret well 3 and is rotatably supported on bearings 5. The turret is geostationary and is connected to a subsea oil structure by means of one or more risers 6. The vessel 2 can weathervane around the geostationary turret 4. Trough the riser 6, hydrocarbons are supplied to a swivel assembly 7 where the hydrocarbons are transferred to product piping 8. The swivel assembly 7 provides a rotatable connection between the geostationary riser 6 and the rotating product piping 8.

The swivel assembly 7 comprises a number of individual swivels 10,11,12. Each swivel comprises an outer annular wall 13 and an inner annular wall 14. The annular walls 13,14 are mutually connected by means of axial and radial bearings 15 and 16.

The walls 13 and 14, which can rotate with respect to one another, define an annular or toroidal chamber 17. Openings 18,19 are provided in the inner and outer walls 14 and 13. Via the openings 18,19 the product piping 8 and the riser 6 are connected to the central toroidal chamber 17.

Between the abutting faces of the inner and outer annular walls 13,14 sealing elements are present, which for reasons of clarity are not shown in the drawings.

As can be seen in FIG. 1, each outer annular wall 13 of each swivel is connected to a frame 21 via connecting means 22,23. The connecting means 22,23 can be disconnected from the outer wall 13 or from the frame 21 such that each individual swivel 10,11,12 can be removed from the assembly 7.

The frame 21 is fixedly connected to the turret 4. The inner walls 14 of the swivels 10,11,12 in the assembly 7 are mutually connected by means of rotation transfer members or bolts 24. The inner annular wall 14 of the upper swivel 10 is connected to a gantry 25 via a rotational drive mechanism 26 or they can be individually driven by a gear drive and motor on a passive structure extending down from gantry 25. The rotational drive mechanism 26 may for instance comprise one or more motor drives for turning the inner rings 14 individually, in sets or totally in conjunction with the position of the vessel with respect to the turret. A rigid coupling between the gantry 26 and the inner rings 14 is not preferred as this could generate problems due to relative motions between the gantry and turret attachment. A rotationally rigid but laterally flexible rotational mechanism could be used to turn the swivel walls 14 from the gantry.

Although the riser 6 and the product piping 8 are shown only for the upper swivel 10, each swivel in the assembly 7 comprises one or more respective risers and one or more respective product pipes such that each time at least three ducts will extend at the outside of the swivel assembly 7 and at least three ducts will extend through the central space 27 of the swivel assembly 7.

Figure 2:
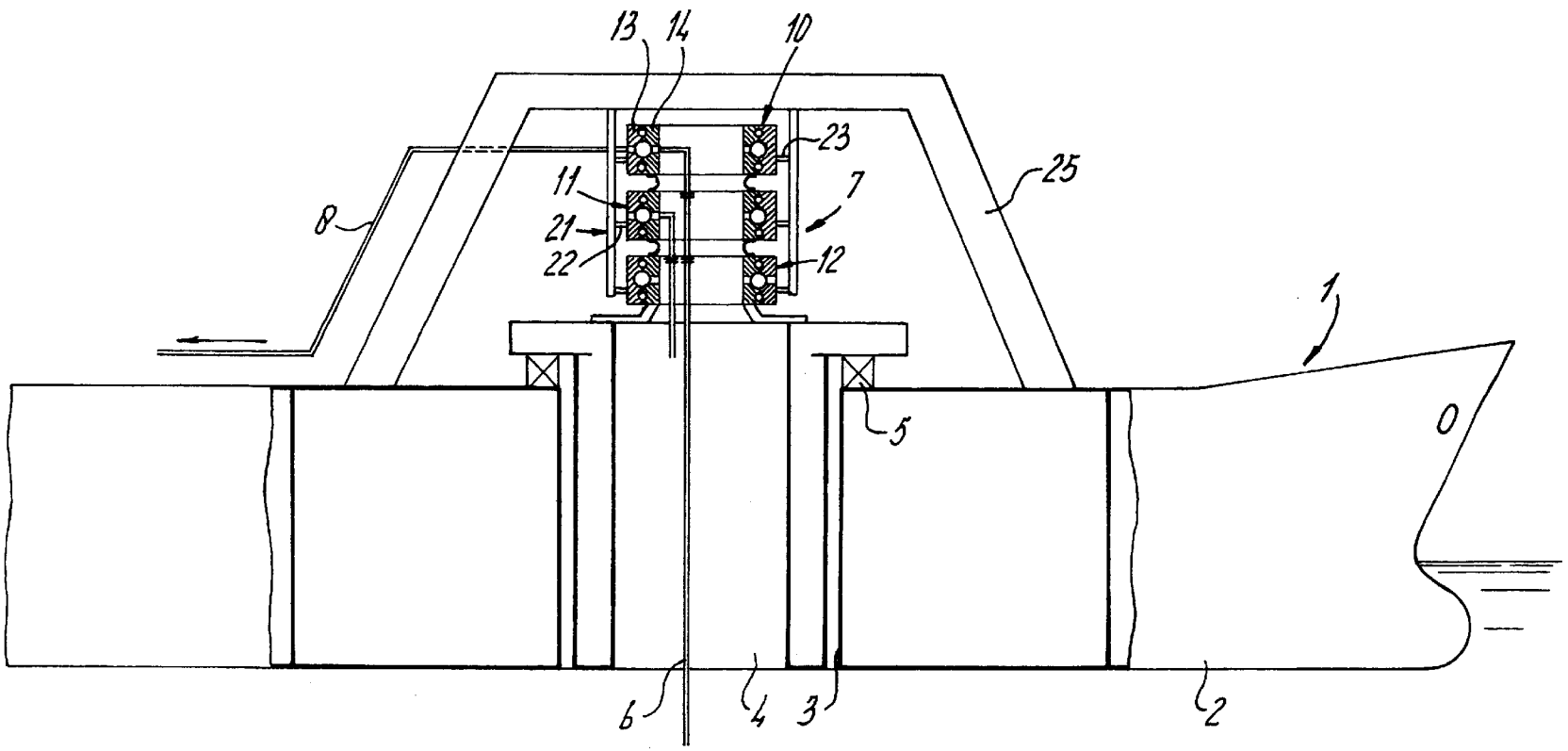
FIG. 2 is a schematic side view of a swivel assembly according to the present invention wherein the frame is connected to a gantry.
Figure 6:
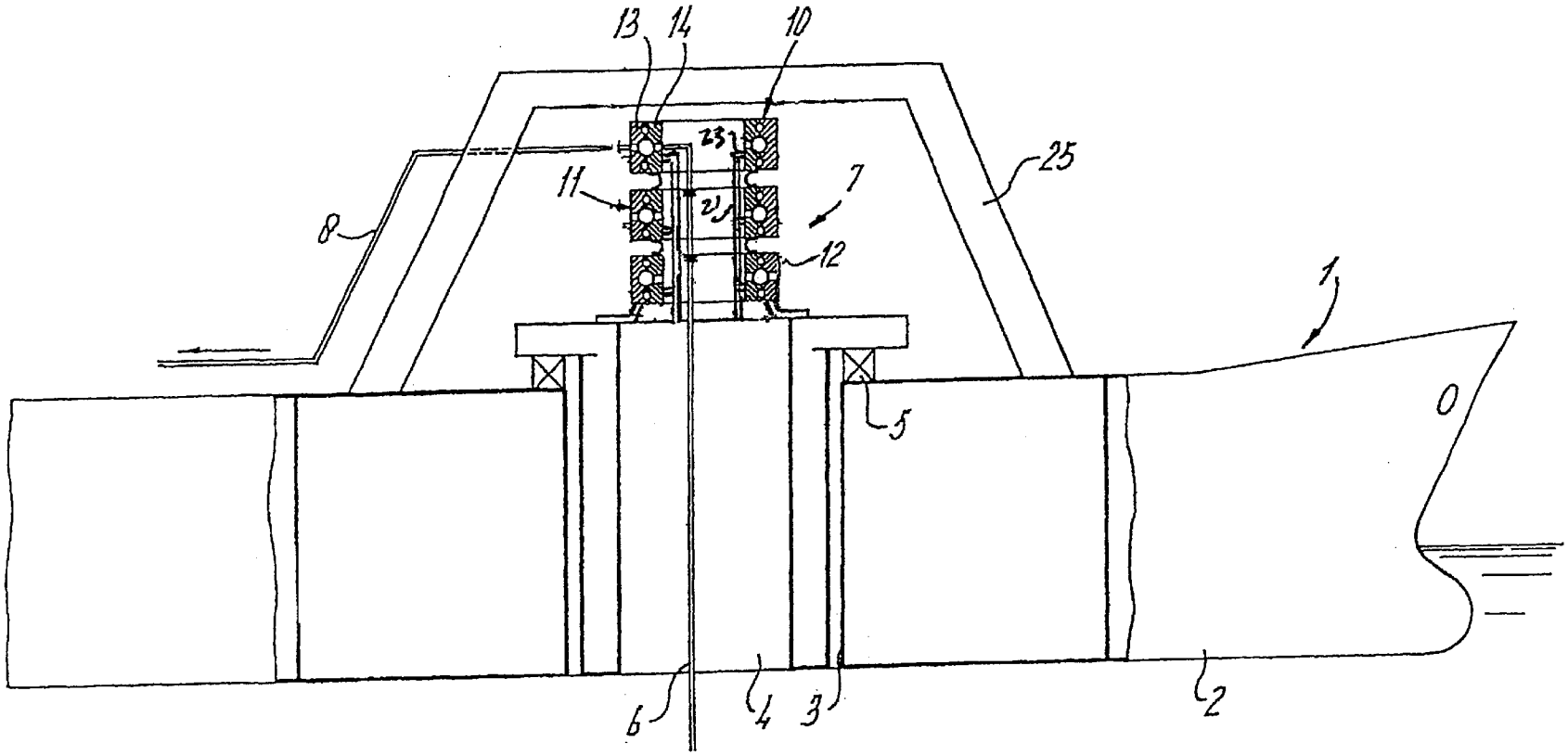
FIG. 6 shows another schematic side view of a swivel assembly.

FIG. 2 shows an embodiment wherein the frame 21 is suspended from the gantry 25. The inner annular walls 14 of the swivels in the assembly 7 are fixedly connected to the turret 4. Due to the relatively light weight of the outer annular walls, they can be directly connected to the gantry 26 via the frame 21. An alternative arrangement is shown by FIG. 6.

Figure 3:
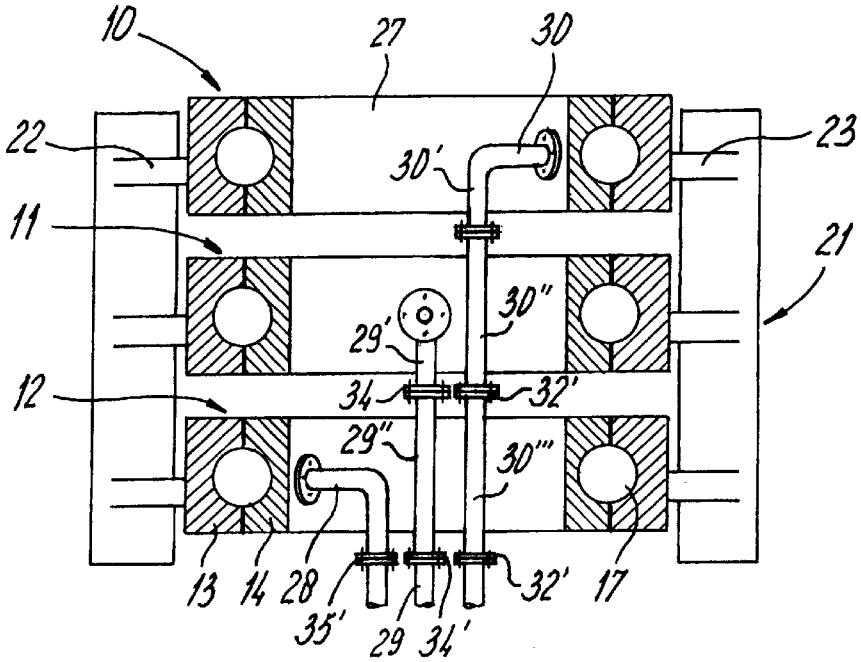
FIG. 3 shows an axial cross-sectional view of a swivel assembly according to the present invention wherein the piping is comprised of pipe segments.

As can be seen in FIG. 3, three ducts 28,29,30 extend within the central space 27. The first duct 28 is connected to the central chamber 17 of the swivel 12. The second duct 29 is connected to the second swivel 11 and the third duct is connected to third swivel 10. The duct 30 comprises three segments 30',30" and 30'". The three segments are interconnected by means of flanges $32^{IV}$. The duct 29 is comprised of two segments 29',29" connected via a flange 34. The duct 28 comprises a flange 35'. For removal of the swivel 12, the connecting means of that swivel are decoupled from the frame 21. The pipe 28 is decoupled at its flange 35', the pipe 29 is decoupled at its flanges 34,34' and the pipe 30 is decoupled at its flanges $32^{IV}$. After loosening the outer piping of swivel 12, and loosening the connecting elements, it can be removed from the assembly in a radial direction.

Figure 4:
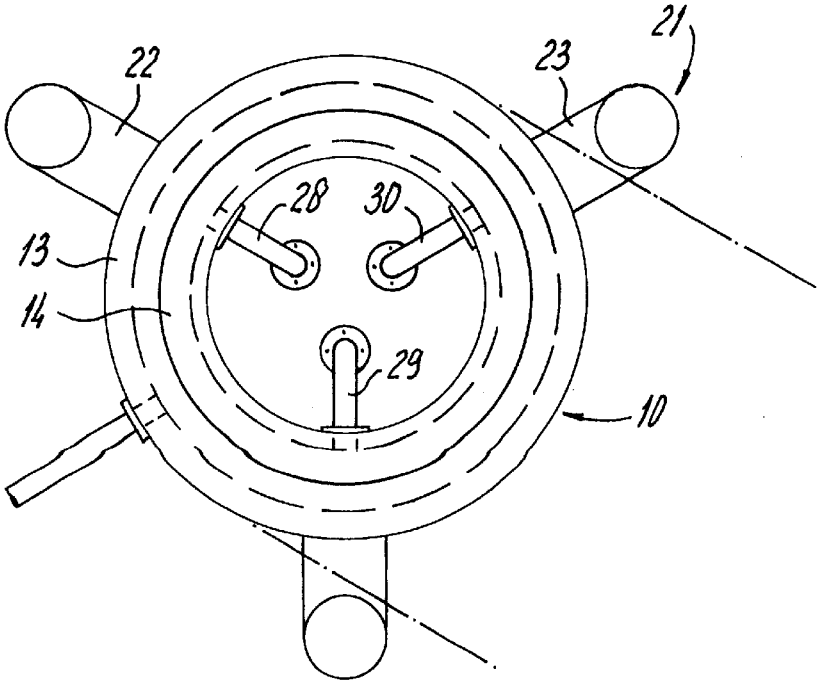
FIG. 4 shows a radial cross-sectional view to the swivel assembly according to FIG. 3, wherein the space between the support elements of the frame is shown.

As can be seen in FIG. 4, the distance between the legs of frame 21 is larger than the diameter of the swivels 10,11,12. Thereby the swivels can pass between the connecting elements 22,23.

Figure 5:
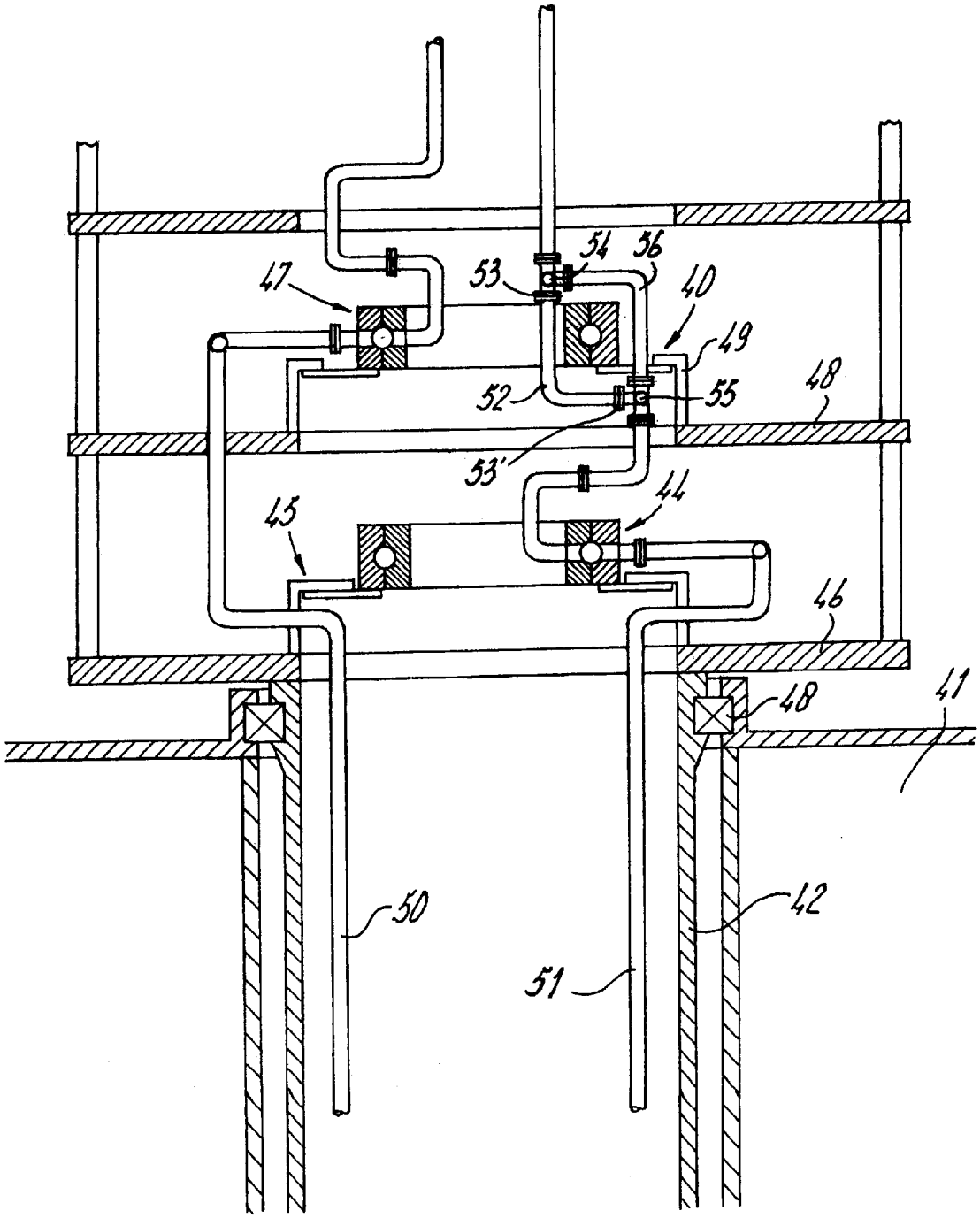
FIG. 5 shows another embodiment of a swivel assembly according to the present invention, including a temporary bypass construction along a pipe segment.

FIG. 5 shows an embodiment of a swivel assembly 40 connected to several separate decks of a turret. The turret 42 is rotatably connected via bearing 48 to the hull of the vessel 41. A first swivel 44 is via a swivel support 45 connected to a first deck 46 of the turret 42. A second swivel 47 is connected to a second deck 48 via an individual swivel support 49. The outer walls of each swivel 44, 47 are connected to a pipe manifold 50,51. The piping at the position of the upper swivel 47 comprises a pipe segment 52 which may be disconnected for removal of the upper swivel 47 or the lower swivel 44 from their supports 40,49. Each swivel 44,47 is easily accessible via its respective deck for maintenance purposes. As the swivels are not interconnected in a weightbearing manner, each swivel can be easily replaced without disturbance of the operation of the other swivels, at a minimum down time.

In FIG. 5, a bypass construction around pipe segment 52 is shown which is applied when the swivel 47 needs to be replaced. The pipe segment 52 comprises at its outer ends coupling flanges 53,53'. Each coupling flange is detachably connected to a two-way valve 54,55. The two-way valves 54,55 are connected to the temporary bypass 56. After the bypass 56 has been put in place, the pipe segment 52 can be decoupled at its flanges 53,53' and the swivel 47 can be removed for the assembly for repair purposes. After repair, or maintenance the swivel 47 can be replaced in its original position and the pipe segment 52 can be put back in place and the bypass 56 can be removed. This bypass construction is only possible when a limited degree of weathervaning of the vessel around the turret is possible, otherwise the bypass piping 56 will clash with the other product piping. By means of this bypass construction the down time can be reduced during repair or maintenance.

Although it has been described in the appended figures that each swivel is an individual unit which is not interconnected in a weight bearing manner to an adjacent swivel, it may occur that smaller type swivels or electrical swivels are connected to any one of the swivels in the assembly as shown in the figures without departing from the scope of the present invention.

What is claimed is:

1. Offshore structure comprising:

a swivel assembly with at least two swivels having a substantially common central axis, and a support structure carrying the swivel assembly, each swivel comprising an inner annular wall and concentric therewith an outer annular wall, the annular walls being connected via axial and radial bearings and defining a ring-shaped chamber therebetween, the support structure comprising connecting means connected to a respective outer or inner annular wall of the respective swivels and substantially carrying the weight of each swivel, wherein no substantial weight-bearing constructions are present between the inner walls of the adjacent swivel units and between the outer walls of the swivels.

2. Offshore structure comprising:

a swivel assembly with at least two swivels having a substantially common central axis, and a support structure carrying the swivel assembly, each swivel comprising an inner annular wall and concentric therewith an outer annular wall, the annular walls being connected via axial and radial bearings and defining a ring-shaped chamber therebetween, the support structure comprising connecting means connected to a respective outer or inner annular wall of the respective swivels and substantially carrying the weight of each swivel, wherein the inner walls comprise an opening that is in fluid communication with the ringshaped chamber and that is on one side in fluid communication with a duct connected to the inner wall, the ducts of the swivels extending in axial direction within a central space bounded by the inner annular walls, the duct that is connected to the inner wall of a first swivel, in the region corresponding to a second swivel located above or below the first swivel, is comprised of detachable pipe segments for removal of the second swivel in the radial direction.

3. Offshore structure according to claim 2, wherein each pipe segment comprises at its ends a coupling flange, each coupling flange being detachably connected to a two-way valve for attaching to a bypass duct.

4. Offshore structure according to claim 2, further comprising a hull having a cylindrical turret well and a turret rotably placed inside the turret well, wherein the supporting structure comprises a frame mounted on the turret or the hull, the frame being placed in such a position with respect to the swivels that after disconnecting the connecting means of a swivel, the swivel can be removed from the assembly in a radial direction.

5. Offshore structure according to claim 4, wherein the frame is supported on the turret, the inner annular walls being mutually coupled by a rotation transfer member, at least one of the inner walls being connected to rotation drive means that is connected to the hull.

6. Offshore structure to claim 5, further comprising a gantry extending above the turret, the rotation drive means being carried by the gantry.

7. Offshore structure according to claim 4, further comprising a gantry extending above the turret, the frame being suspended from the gantry, the inner annular walls of the swivel being mutually coupled by a rotation transfer member, at least one of the inner walls being fixedly connected to the turret.

* * * * *